US010150588B2

(12) United States Patent
Leboucher

(10) Patent No.: US 10,150,588 B2
(45) Date of Patent: Dec. 11, 2018

(54) PANEL FOR A CONTAINER, A CONTAINER PROVIDED WITH SUCH CONTAINER AND A METHOD FOR MAKING SAME

(75) Inventor: Fabrice Leboucher, Angers (FR)

(73) Assignee: Ardagh MP Group Netherlands B.V., Deventer (NL)

( * ) Notice: Subject to any disclaimer, the term of this patent is extended or adjusted under 35 U.S.C. 154(b) by 0 days.

(21) Appl. No.: 13/509,408

(22) PCT Filed: Nov. 12, 2010

(86) PCT No.: PCT/EP2010/067381

§ 371 (c)(1),
(2), (4) Date: Jul. 31, 2012

(87) PCT Pub. No.: WO2011/058138

PCT Pub. Date: May 19, 2011

(65) Prior Publication Data

US 2012/0279967 A1 Nov. 8, 2012

(30) Foreign Application Priority Data

Nov. 12, 2009 (EP) ..... 09075503

(51) Int. Cl.
*B65D 17/28* (2006.01)

(52) U.S. Cl.
CPC .. *B65D 17/4011* (2018.01); *B65D 2517/0016* (2013.01); *B65D 2517/0062* (2013.01); *B65D 2517/0079* (2013.01)

(58) Field of Classification Search
USPC ..... 220/269, 270
See application file for complete search history.

(56) References Cited

U.S. PATENT DOCUMENTS

| | | | | |
|---|---|---|---|---|
| 5,335,808 | A * | 8/1994 | Lee | 220/269 |
| 5,804,237 | A * | 9/1998 | Diamond | A23L 3/02 426/131 |
| 7,168,586 | B2 * | 1/2007 | Jeon | 220/269 |
| D565,406 | S * | 4/2008 | Foskett | D9/438 |
| 2005/0224497 | A1 * | 10/2005 | Wook | 220/269 |
| 2007/0108209 | A1 * | 5/2007 | Jeon | 220/269 |
| 2008/0197132 | A1 * | 8/2008 | Hasegawa et al. | 220/269 |
| 2008/0314906 | A1 * | 12/2008 | Butcher et al. | 220/272 |
| 2010/0213194 | A1 * | 8/2010 | Liu | B65D 17/165 220/269 |
| 2011/0186575 | A1 * | 8/2011 | Dunwoody et al. | 220/270 |
| 2011/0308202 | A1 * | 12/2011 | Hall | 53/467 |
| 2012/0043325 | A1 * | 2/2012 | Williams et al. | 220/270 |

FOREIGN PATENT DOCUMENTS

| | | | |
|---|---|---|---|
| EP | 1958882 | A1 | 8/2008 |
| WO | 03104092 | A1 | 12/2003 |
| WO | 2009090171 | A1 | 7/2009 |

* cited by examiner

*Primary Examiner* — James N Smalley
*Assistant Examiner* — Madison L Poos
(74) *Attorney, Agent, or Firm* — The Webb Law Firm

(57) ABSTRACT

A panel for a container includes an outer edge to be connected to the container and a tab connected to the panel. The tab has a rear tab part for gripping by a user and a front tab part for engagement with the panel and forming an opening in the panel. The panel is provided with deformation means which structurally deform upon a transition of the panel into a convex shape and which locked in the deformed state urge the panel to a substantially flat or concave shape.

11 Claims, 5 Drawing Sheets

PANEL FOR A CONTAINER, A CONTAINER PROVIDED WITH SUCH CONTAINER AND A METHOD FOR MAKING SAME

BACKGROUND OF THE INVENTION

Field of the Invention

The present invention relates to a panel for a container, to a container provided with such panel and to a method for making such a container.

Description of Related Art

The present invention relates to panels for a container which panels are provided with a tab for forming an opening in the panel so that the content of the container becomes available to the user. An important type of such containers is a so called easy opening container. The user is to grasp the tab at its free end part and by pivoting or levering the tab the front tab parts engages the panel and urges an opening in the panel. Generally the opening is defined and formed by a weakened part of the panel, such as by a score line. This score line defines the entire or part of the opening so that the scored and torn out part may remain in contact with the panel or is torn loose.

In order to facilitate the grasping of the free end tab part is the tab often in an inclined position providing a larger finger access. However, the free end part should not extend beyond the boundaries of the panel, in particular not beyond the outer edge and the bottom part of the panel. Otherwise the extending free tab part may hook behind obstacles during manufacture, and application of the panel on a container, and during handling, filling and closing of the container.

EP 1958882 discloses a panel and a container of the easy opening type. The finger access is improved by forming beneath the free end tab part a concave or inwardly extending part. This concave part is not present in the panel during its handling or manufacture but is formed after the application of the panel on the container and due to a negative pressure over the panel on the closed off container. This negative pressure is generated after filling and closing the container. For instance, such negative pressure may be formed after hot filling the container and subsequent cooling. The then acquired concave form results in the formation of the finger access. The required negative pressure difference is generally in the order of about −0.4 bar to −1.0 bar.

The known easy opening panel functions very well and is well received by the market. There are however circumstances under which it is desired that the formation of the concave form requires a much smaller or even no pressure difference. Relevant circumstances comprise hot filling resulting in a small negative pressure difference such as warm instead of hot filling, overfilling resulting in a small or even no head space above the filled content. Still it is desirable that an optimal finger access is formed but only after application of the panel an the container and closing the container.

SUMMARY OF THE INVENTION

Accordingly, the invention has for its object to provide a panel for a container which allows the transition (or flipping) of the panel from a convex into a concave shape at a minor or even no pressure difference over the panel closing of the container. Yet it is preferred that the panel displacement (in particular over its height) is small at least up to the transition from the convex to concave shape. Then such panel and container may be manufactured, transported in stacked piles, and fed to seaming and closing apparatuses using standard equipment and manufacturing methods.

This object of the invention is obtained with a panel according to the invention, which panel has an outer edge to be connected to the container and a tab connected to the panel, wherein the tab has a rear tab part for gripping by a user and a front tab part for engagement with the panel and forming an opening in the panel, and wherein the panel is provided with deformation means which structurally deform upon a transition of the panel into a convex shape and which locked in the deformed state urge the panel to a substantially flat or concave shape.

Due to the implementation of the deformation means according to the invention it is possible that after the transition into the convex shape and the structural deformation of the deformation means the panel is subject to an internal stress and/or tensile force urging the panel to a transition into a concave shape. Accordingly, the deformation of the deformation means after filling and closing, results in a force moving the panel into the concave position at a low or in substantial absence of the need of the presence of a pressure difference over the panel. This force is preferably permanently present if the structural deformation of the deformation means is also permanent. That is, if the deformation is the result of an elastic deformation and there is substantially no or only a small recovery of the original form. In essence, the invention makes use to a certain extent of the deformation of a panel upon high container pressures resulting in the formation pleats or bulges in the panel. Such deformations are generally not acceptable and results in a rejection of the container. It is with the present invention that this deformation is taking place in a controlled manner and to an extent that is visually acceptable by the consumer, and allows normal handling, transport, stacking of the container, and does not interfere with the closing function of the panel. Thus, the container of the present invention has still a good aesthetic appearance.

The deformation of the panel during the transition into the convex shape generally takes place in the regions of the panel that show a dynamic behaviour during this transition. Such regions are generally localised in an area of the panel which is radially inwardly of the outer edge which is secured to the container wall. Optimally is this dynamic region localised in the more central part of the panel starting from or more inwardly of the connection of the tab to the panel. According to a preferred embodiment are the deformation means located in at least a flexible and dynamic region of the panel. Thus, a relatively small deformation by relatively low pressures is required for initiating the deformation.

Preferably, are the deformation means located beneath the rear tab part of the tab. This has the advantage that the deformation is hardly or even not visible to the consumer.

If the deformations are not very visible in the deformed panel or when such deformation may be visible to a certain extent then it is preferred that the deformation means are located at at least one side of the tab, in which case location at both sides of the tab is preferred for manufacturing and aesthetic reasons.

A very reliable and acceptable embodiment of the deformation means of the invention are obtained if the deformation means are located in a substantially circumferential flexible region of the panel.

Obviously, any combination of the deformation means described may be used provided that the structural deformation is taking place and the transition is almost independent of a small negative or even positive pressure difference over the panel mounted on the container.

Practical embodiments of the deformation means of the invention have the form of a broader terrace step, a radially inwardly inclined terrace, a radially inwardly declined terrace and/or a radially inwardly wavy terrace.

In practice it turned out possible to have a controlled and reliable return of the panel form the convex into a substantially flat or concave shape if the transition from the convex shape into the flat or concave shape occurs at pressure difference over the panel in the range of about −0.3 bar to +0.3 bar, preferably at about −0.2 bar to +0.2 bar, more preferably at about −0.1 to +0.1 bar, or even no pressure difference.

During the various transitions from the original panel shape into the convex shape and subsequently into the flat or concave shape the finger access present is to be preserved and preferably maintained at a desired form and height. Thereto it is preferred that the tab rear part rests on a support formed in the panel. This support determines the shape and form if the finger access independent of the transitions of the panel. In this whole process of forming the flat or concave shape for the enlarged finger access it is preferred that upon the convex transition of the panel a finger access is formed beneath the free end of the tab.

Another aspect of the invention relates to container provided with a panel according to the invention. This container of standard type and form can be provided with a panel of the invention using standard equipment and no increased risk for processing interruptions due to the use of the panel of the invention. It is thereby preferred that the panel has a concave shape and the deformation means are locked in the deformed state, and a finger access is present beneath the free end part of the tab.

Still another aspect of the invention relates to a method for making a panel according to the invention, wherein the panel is provided with inventive deformation means.

DETAILED DESCRIPTION OF THE PREFERRED EMBODIMENTS

Figure 1A:
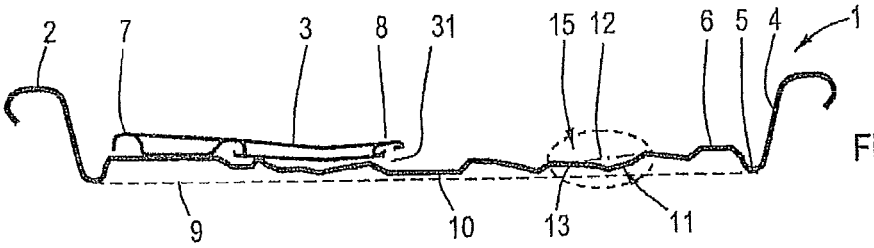
FIGS. 1A, 1B, 1C are cross section views of the various shapes of a panel of the invention.

FIG. 1 shows a panel 1 of the invention. The panel 1 has an outer edge to be connected to the body wall of a container, and a tab 3. The outer edge 2 is connected via a countersink wall 4 and a countersink 5 to a central panel part 6. The tab 3 has a front tab part 7 for engagement with the panel part 6 and for forming an opening in the panel 1 along a score line (not shown). The rear tab part 8 is intended for grasping by the user and for pivoting the front tab part 7 towards the panel 1. The panel 1 has a substantially flat shape. As shown the rear tab part 8 is laterally positioned or the central panel 10. Obviously the rear tab part may also extend over the central panel 10. The panel mid part 10 forms the lowest panel structure. Between this panel mid part 10 and the countersink 5 is a flexible region in the panel 1 which may flex between the shown shape and a more convex shape upon a pressure difference over the panel 1 when mounted on the container or on a testing device.

As shown in FIG. 1A there is in this embodiment diametrically relative to the tab 3 a panel region 11 enclosed by the dashed line 12. This panel region 11 has a shape such that upon application of a pressure difference the panel will be transitioned to the state and shape shown in FIG. 1B. The central panel part 6 is also deformed and has a substantially convex shape. According to the invention, the panel region 11 is an embodiment of deformation means 15 that structurally deform (as shown). The originally concave shape 13 of the panel region 11 is transformed into a convex shape 14 (compare FIGS. 1A and 1B). This transformation into the deformed state is in this case a locked deformed state and thus permanent. This means that after release of the pressure difference the panel region 11 maintains the convex shape.

Figure 1B:
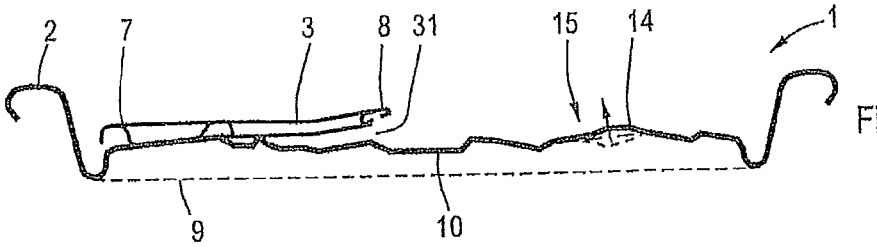
Figure 1C:
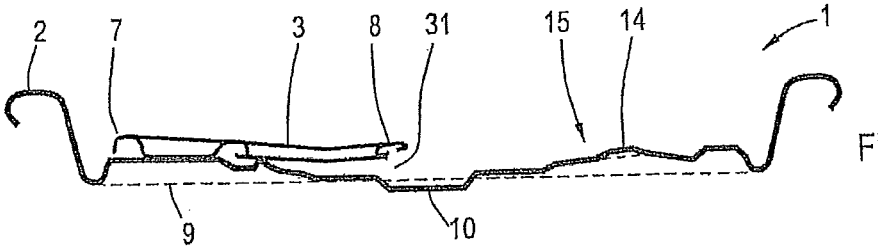

With the formation of the convex shape of the panel 1 is also formed an larger finger access 31 beneath the rear tab part 8. This larger finger access 31 is maintained when, after pressure release the panel 1 retakes its almost original form and shape. Upon pressure increase, as shown in FIG. 1B some more finger-access 31 is formed because the rear tab part 8 goes up more than the central part of the panel. But when the pressure is released the finger-access 31 goes back to substantially the original position, and it is with a small pressure difference according to the invention that the panel 10 flips in concave position to give the larger finger-access 31. However, the deformation means 15 remain in the deformed state having the convex shape 14. In addition, the panel mid part 10 extends beyond the line 9 and thus beyond the original confinement.

Figure 1D:
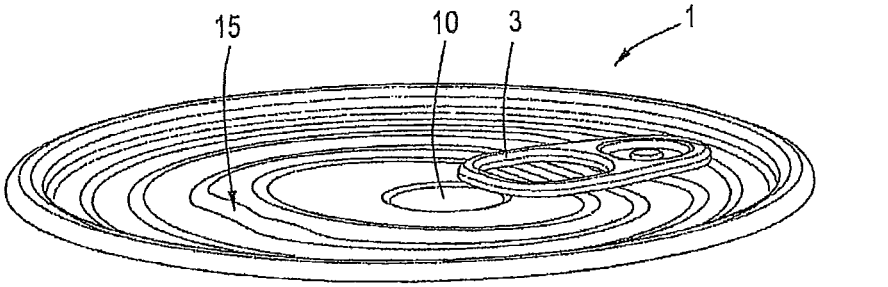
FIGS. 1D and 1E are side views of the convex shape and the concave shape of the panel of FIG. 1A.
Figure 1E:
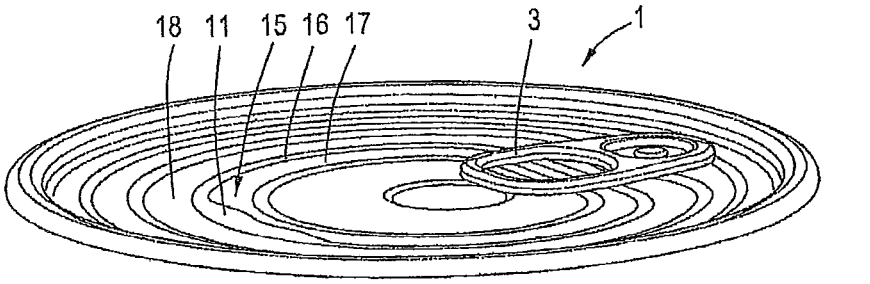

FIG. 1D shows the convex shape of the panel 1 in the region 11 where the deformation means 15 are incorporated in the central panel part 6. As shown in FIG. 1E the deformation means 15 in the panel region 11 have a step 16 between the inner terrace 17 and the radially more outer terrace 18 which has in the panel region 11 a smaller slope than outside this region 11.

Figure 2:
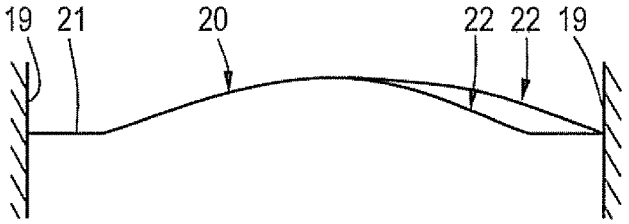
FIG. 2 is a schematic view of schematically a function of the deformation means of the present invention.

The effect of the present invention on relation to the deformation means may be explained by reference to the schematic drawing in FIG. 2, but the possible theory is not binding on the effect of the invention and is solely explanatory. In FIG. 2 the walls 19 illustrate the walls of the container to which the panel 20 is secured. The panel 20 has a circumferential relatively stationary ring panel part 21. Enclosed is the relatively dynamic or flexible panel part 22. Not show in both panel parts 21 and 22 are flexible or harmonica parts formed by for instance the countersink and the terraces, respectively. This deformation urges the panel 20 into a concave shape (not shown). It will be understood that is transition or flipping requires a small or even no force at all, and thus no negative pressure difference.

Figure 3A:
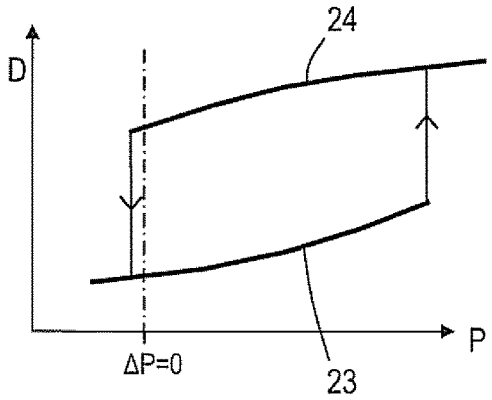
FIGS. 3A and 3B are graphical presentations of the panel displacement D as a function of the pressure difference $\Delta\rho$.
Figure 3B:
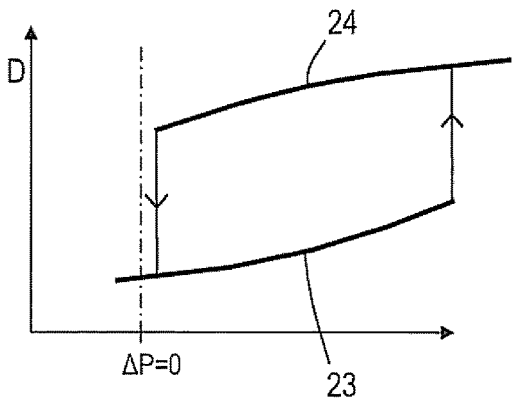

As is shown in FIG. 3 for illustrative purposes only, the panel having in the starting position the concave shape moves (upon pressure increase) along the line 23. Then at a certain positive pressure difference (pressure development in the closed container) the panel transitions or flips into the convex shape. Upon cooling de displacement D decreases slightly along the line 24. Then at a slightly negative pressure (about −0.1 bar) the panel flips back to the concave shape. The panel as shown may take its starting form as shown or takes a slightly distorted shape. In both cases the deformation means 15 are locked in the deformed state, resulting in the required very small (negative) pressure difference required for the transition back to the concave shape. FIG. 3B shows the same mechanism but the transition already takes place at a small positive pressures difference (about +0.1 bar). It is noted, that during the manufacture and the supply, the panel generally may be in a convex position, and that during processing, such as dependent on the cooking conditions, the panel may shift between a convex and concave position one time or several times. Ultimately, the panel will be in the shape determined by the pressure difference.

Figure 4A:
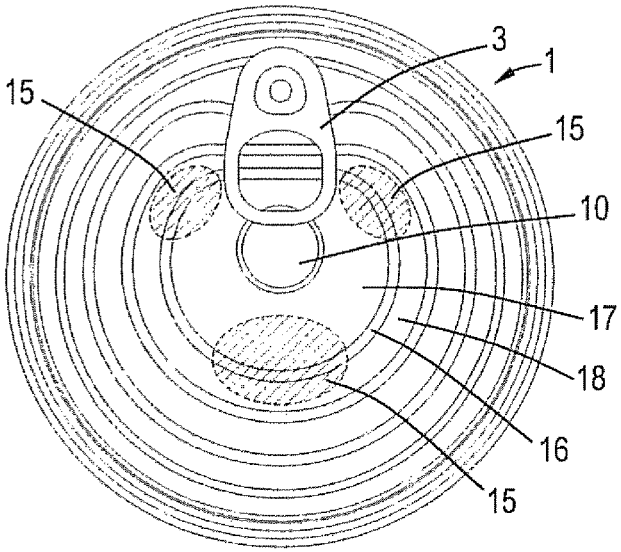
FIGS. 4A, 4B, and 4C are plan views of a panel according to the invention with the preferred locations for the deformation means of the invention.
Figure 4B:
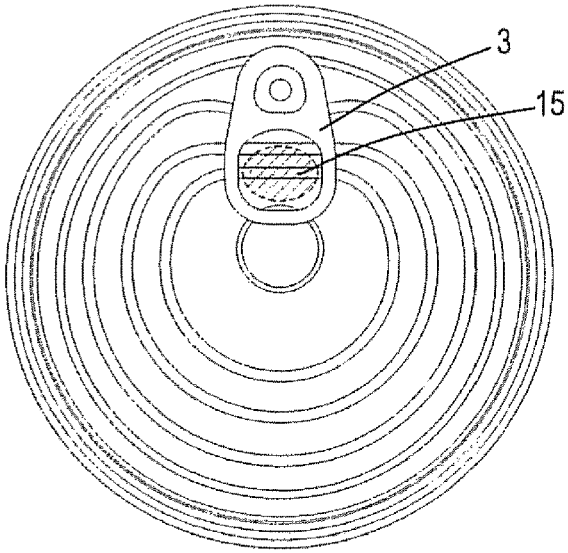
Figure 4C:
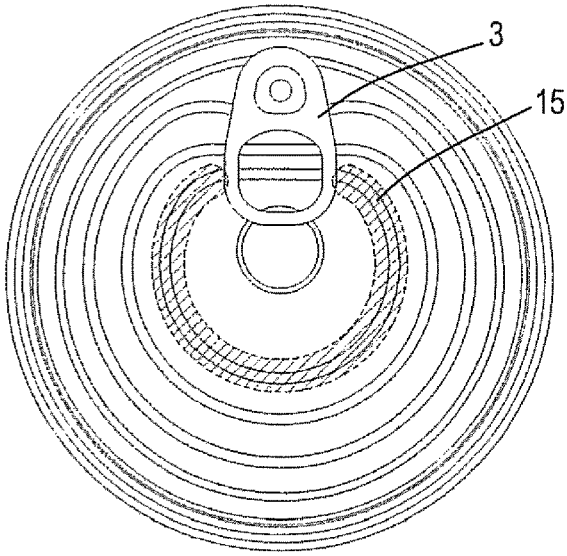

FIGS. 4A, 4B, and 4C show the various locations where according to the invention the deformation means are preferably arranged.

In FIG. 4A are the deformation means arranged laterally of the tab 3 and as a further option or in the alternative diametrically of the tab 3. As discussed the deformation means 15 are exemplified to take the form of a broadened of the step 16 between the terraces 17 and 18. Other forms of the deformation means are possible (as discussed hereafter) and other locations circumferentially or radially are possible. These local deformations are preferred as they are in regions where pleats and bulges may form under overpressure and easy to form during panel manufacture.

FIG. 4B shows the deformation means 15 located beneath the tab 3. This is advantageous for situations where the deformation is relatively visible for the customer but shielded at least partly by the tab 3.

FIG. 4C shows the deformation means 15 in an interrupted annular over the region which has the highest flexibility and vulnerability for deformation. The interruption is near the tab 3, so that there is a minimum interference with the tab function.

Figure 5A:
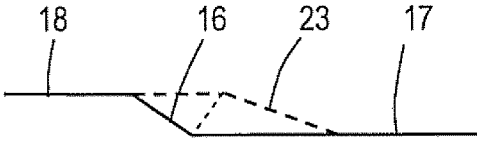
FIGS. 5A and 5B are graphical presentations relating to the invention.
Figure 5B:
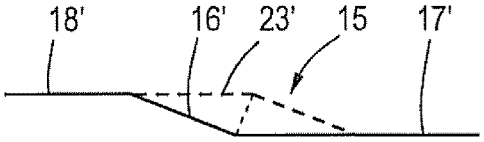

FIGS. 5A and 5B show more in detail an embodiment of the deformation means 15 of the invention in the panel 29. In FIG. 5A the step 16 between the terraces 18 and 17 is relatively steep and thus rigid or resistant to deformation. In FIG. 5B is the step 16' broader and thus less stiff and more prone to deformation. The deformation is structurally permanent as it is the result of a plastic deformation as shown by the dashed lines 23 and 23' in the FIGS. 5A and 5B.

Figure 5D:
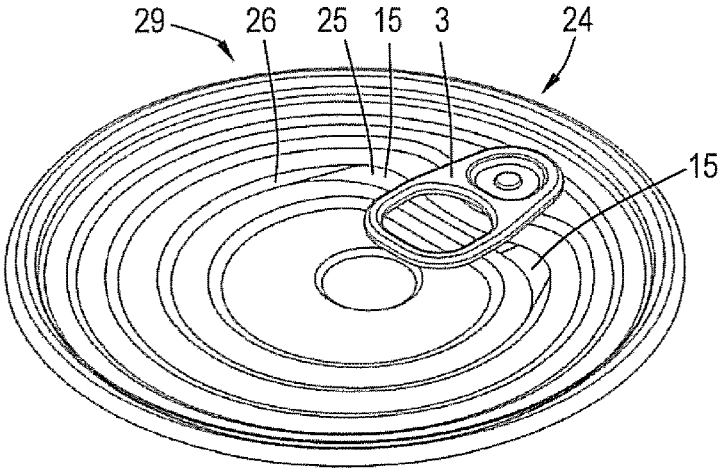
FIGS. 5C and 5D are further views of another embodiment of the invention.
Figure 5C:
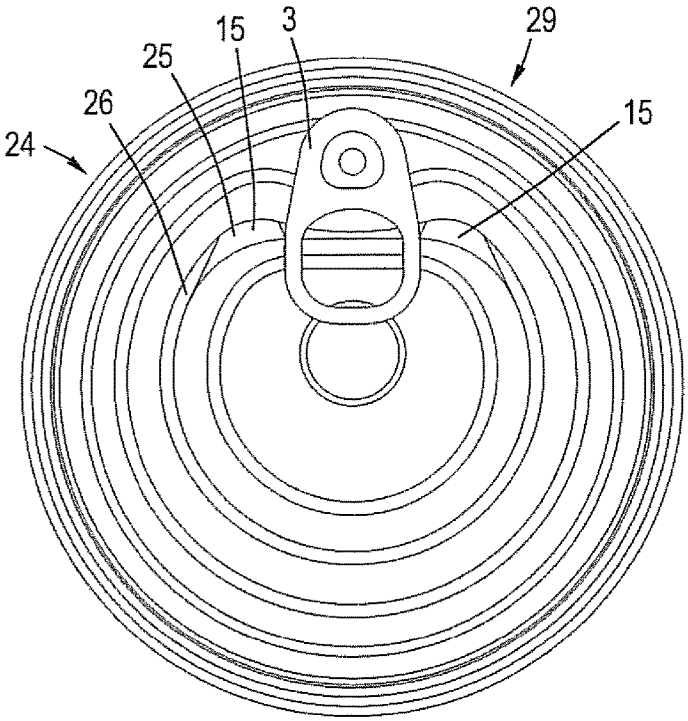

FIGS. 5C and 5D show a panel 24 according to the invention wherein the deformation means 15 of the invention are located sidewise of the tab 3 and have the form of broadened steps 25 adjacent the smaller step part 26.

Figure 6A:
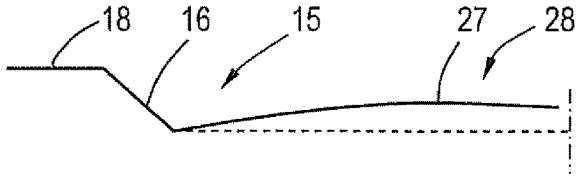
FIGS. 6A, 6B, and 6C are further views of a further embodiment of the invention.
Figure 6C:
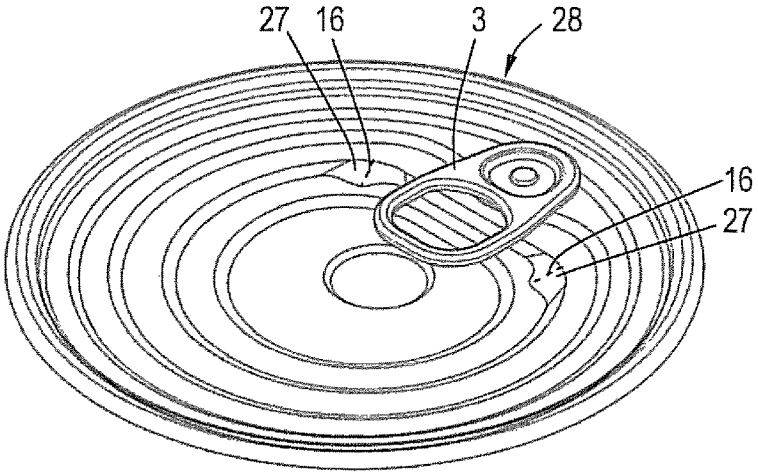
Figure 6B:
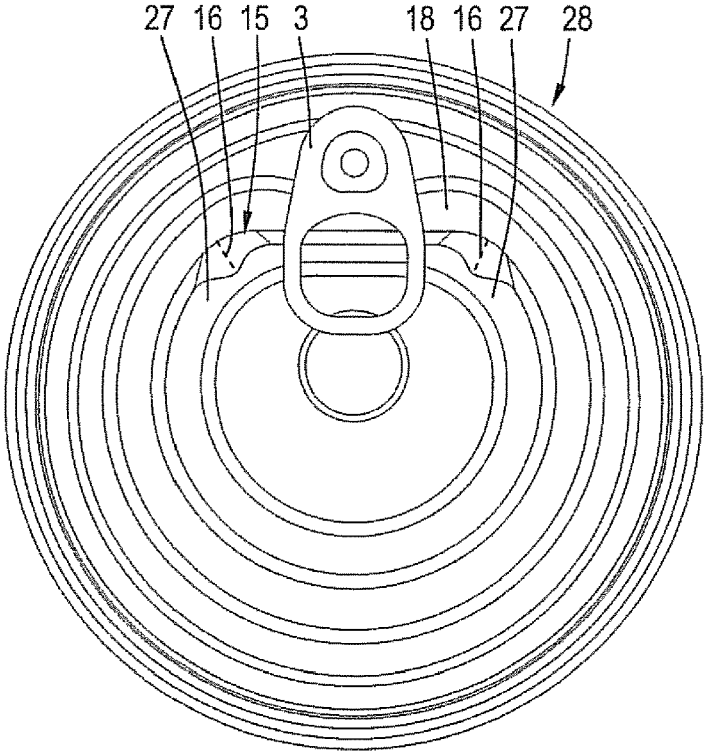

FIG. 6A shows another embodiment of the deformation means 15 of the invention incorporated in the panel 28. In this embodiment the step is relatively broad and the radially more inward terrace 27 has an inclined or even dome shape. As in the embodiment of FIG. 4A the deformation means 15 are located adjacent to the tab 3.

Figure 7:
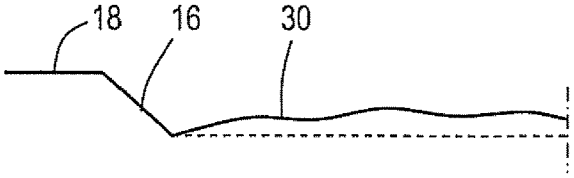
FIG. 7 is a cross section view of still another embodiment of the invention.

In comparison to FIG. 6A, FIG. 7 shows another embodiment of the deformation means 15 of the invention. The step 16 is broadened and the more radially inward terrace 30 has a wavy form. Still upon a pressure difference the deformation means 15 will deform and in the maintained deformed state after pressure reduction will urge the panel of the invention into a flat or concave shape.

As discussed above the relatively small negative or even positive pressure difference at which the panel with the deformation means in the deformed state will transition or flip into the concave shape is in the order of about −0.2 to +0.2 bar or even less. This provides an elegant panel that retakes its concave shape without the need of a larger negative pressure or additional mechanical impact from the outside. The deformation is substantially plastic indicating that the deformation is substantially permanent whereby the transition to the concave shape almost always will take place without.

The panel and the container may be made of any suitable metal such as aluminium, steel, tin plate and mixtures thereof. The panel may have any traditional shape as long as the implementation of the deformation means is possible. The panel and the container may be of any suitable diameter, such as up to 99 mm.

Finally, containers provided with a panel of the invention may be filed with liquid, paste like or solid material, such as pet food and beverages. Still traditional equipment for subjecting the filled and closed container to a heat treatment may be used.

The invention claimed is:

1. A panel for a container, comprising an outer edge for connection to the container and a tab connected to the panel, wherein the tab has a rear tab part for gripping by a user and a front tab part for engagement with the panel and forming an opening in the panel, wherein the panel is provided with deformation means, which structurally and substantially plastically deform upon a transition of the panel into a convex shape due to a pressure difference over the panel and which, locked in the deformed plastic state, urge the panel to a substantially flat or concave shape, wherein the deformation means are located between a central panel portion of the panel and the outer edge of the panel such that the deformation means are located at least one of a) laterally of the tab; b) diametrically opposed to the tab relative to the central panel portion; and c) annularly around the central portion of the panel with an interruption created by the tab, and wherein, upon the convex transition of the panel, a finger access is formed beneath a free end of the tab and the finger access is maintained when the panel is urged by the deformation means to the substantially flat or concave shape.

2. The panel according to claim 1, wherein the deformation means are located in at least a flexible region of the panel.

3. The panel according to claim 2, wherein the deformation means are located in a substantially circumferential flexible region of the panel.

4. The panel according to claim 1, wherein the deformation means have the form of at least one of the following: a broader terrace step, a radially inwardly inclined terrace, a radially inwardly declined terrace and/or a radially inwardly wavy terrace.

5. The panel according to claim 1, wherein the transition from the convex shape into the flat or concave shape occurs at pressure difference over the panel in the range of about −0.3 bar to +0.3 bar.

6. The panel according to claim 1, wherein the tab rear part rests on a support formed in the panel.

7. A container provided with a panel according to claim 1.

8. The container according to claim 7, wherein the panel has a concave shape and the deformation means are locked in the deformed state.

9. The panel according to claim 1, wherein the transition from the convex shape into the flat or concave shape occurs at pressure difference over the panel in the range of about −0.2 bar to +0.2 bar.

10. The panel according to claim 1, wherein the transition from the convex shape into the flat or concave shape occurs at pressure difference over the panel in the range of about −0.1 bar to +0.1 bar.

11. The panel according to claim 2, wherein the deformation means have the form of at least one of the following: a broader terrace step, a radially inwardly inclined terrace, a radially inwardly declined terrace and/or a radially inwardly wavy terrace.

* * * * *